United States Patent [19]

Carver

[11] 4,377,235

[45] Mar. 22, 1983

[54] FLAPLESS CARRIER FOR ARTICLES

[75] Inventor: Robert G. Carver, Ashland, Ohio

[73] Assignee: Don Coburn, Inc., Ashland, Ohio

[21] Appl. No.: 202,359

[22] Filed: Oct. 30, 1980

[51] Int. Cl.[3] ..... B65D 73/00

[52] U.S. Cl. ..... 206/477; 206/426; 206/429; 206/460; 206/521; 206/813

[58] Field of Search ..... 206/426, 429, 460, 521, 206/477, 813

[56] References Cited

U.S. PATENT DOCUMENTS

| | | | |
|---|---|---|---|
| 1,861,530 | 6/1932 | Hayden et al. | 206/460 |
| 2,202,509 | 5/1940 | Addis et al. | 206/460 |
| 2,744,624 | 5/1956 | Hoogstoel et al. | 206/426 |
| 3,080,997 | 3/1963 | Brown | 206/460 |
| 3,374,884 | 3/1968 | Chinkes | 206/460 |
| 3,759,378 | 9/1973 | Werth | 206/429 |
| 3,994,397 | 11/1976 | Fishlove | 206/429 |
| 4,155,450 | 5/1979 | Schillinger | 206/426 |
| 4,234,081 | 11/1980 | Champlin | 206/429 |

*Primary Examiner*—Joseph Man-Fu Moy

*Attorney, Agent, or Firm*—Squire, Sanders & Dempsey

[57] ABSTRACT

A carrier for articles having two opposed ends, the carrier having a sleeve and flapless latches for retaining the articles within the carrier. The latches may include cubic masses of cured foamed plastic adhesive proximate to or bearing on the end portions of the articles to retain and cushion them within the carrier.

7 Claims, 4 Drawing Figures

FLAPLESS CARRIER FOR ARTICLES

BACKGROUND OF THE INVENTION

Various paperboard carriers for the transportation, storage and/or display of articles similar in height and breadth, such as cans, tumblers, goblets and the like have been devised. Some carriers are intended to receive and hold the articles within the carriers through the use of a snugly fitting pierced carrier sleeve such as disclosed by Weiss in U.S. Pat. No. 3,223,306 issued Dec. 14, 1965 and by Gentry in U.S. Pat. No. 3,386,643 issued June 4, 1968. Others use flaps, cut to surround entirely or partially the end portions of the articles, or latches, formed to engage the inside edges of chimed cans or hollow articles, in order to retain the articles within the carriers. Examples of flap and latch restraints are disclosed, for example, by Phipps in U.S. Pat. No. 2,722,365 issued Nov. 1, 1955, Empkie in U.S. Pat. No. 2,637,476 issued May 5, 1953, Tolaas in U.S. Pat. No. 3,283,990 issued Nov. 8, 1966, Nowak in U.S. Pat. No. 3,598,302 issued Aug. 10, 1971, Hennessey in U.S. Pat. No. 3,854,580 issued Dec. 17, 1974 and Tranquillitsky in U.S. Pat. No. 3,999,660 issued Dec. 28, 1976.

The disclosed inventions using pierced carrier sleeves are not suitable for use with fragile articles such as glass tumblers and goblets because those carriers require the articles to bear upon each other and be tightly wrapped. Carriers having flaps for chimed or hollow end articles require numerous cuts in the formation of the blank and bends in the assembly of the blank from which the carrier is made, increasing the cost of manufacture. Use of flaps to surround all or part of an article requires a relatively large quantity of material to form the carrier making it relatively costly.

SUMMARY OF THE INVENTION

It is an object of the present invention to provide a carrier for similarly sized articles, having two opposed end portions, using a minimum amount of material. Another object is to provide a carrier capable of retaining both fragile and non-fragile articles. Yet another object is to provide a carrier for retaining articles having solid end portions as well as articles having at least one chimed, hollow or recessed end portion. A further object is to provide a carrier that is simple in construction and assembly, yet provides a high degree of structural integrity and reliability against inadvertent separation of an article from the carrier.

The objects of the invention are achieved through the use of a simple carrier sleeve having frictional or retaining elements affixed to its inside top and bottom walls. The retaining elements restrain or engage the ends of the carried article or articles to retain them within the carrier. The retaining elements are preferrably resilient to cushion the carried articles. In a preferred embodiment, the retaining elements are cured masses of foamed adhesive formed in solid shapes, for example hemispheric or elongate, disposed about the periphery of the ends of the carried articles. In the case of an article with a chimed, recessed or hollow end, some of the frictional elements may be disposed within the periphery of the end. A carrier accommodating pairs of articles may also be provided with a central reinforcing panel separating the pairs of articles to add to the structural integrity of the carrier and to cushion further the carried articles.

Further objects and advantages of the present invention will become apparent to the skilled artisan upon examination of the detailed description of the invention taken in conjunction with the figures of drawings.

DETAILED DESCRIPTION OF THE PREFERRED EMBODIMENTS

In order to explain more fully the various objects and advantages of the present invention, the invention will now be described with reference to certain preferred embodiments thereof. However, the skilled artisan will appreciate that such a description of preferred embodiments is intended to be illustrative only, and is not deemed to be limiting.

Figure 1:
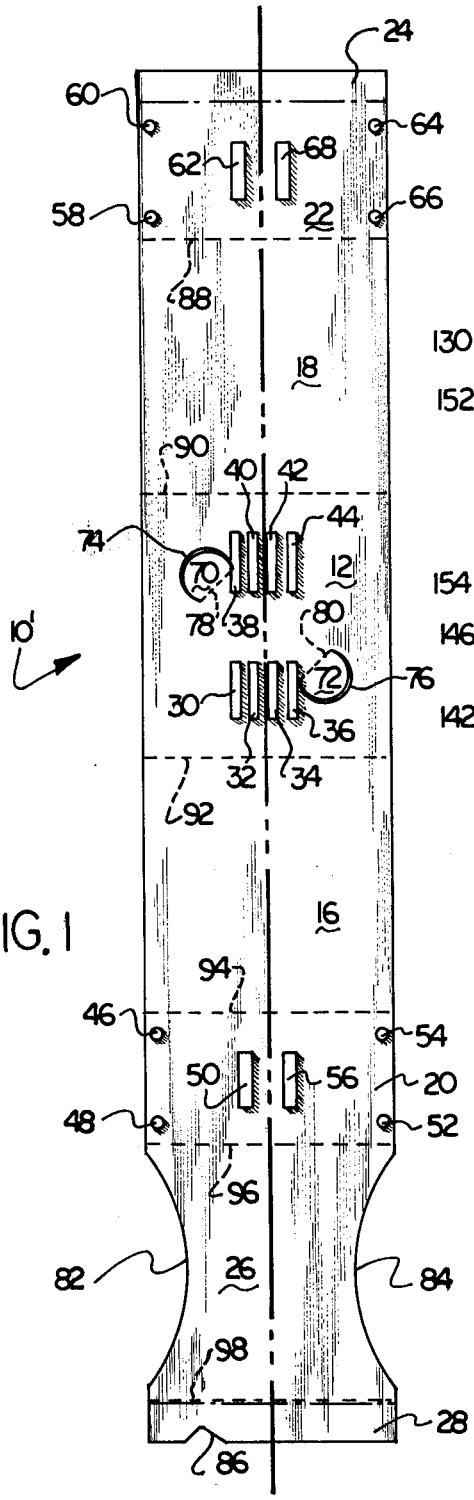
FIG. 1 is a plan view of an embodiment of a blank from which a carrier of the present invention may be formed.
Figure 2:
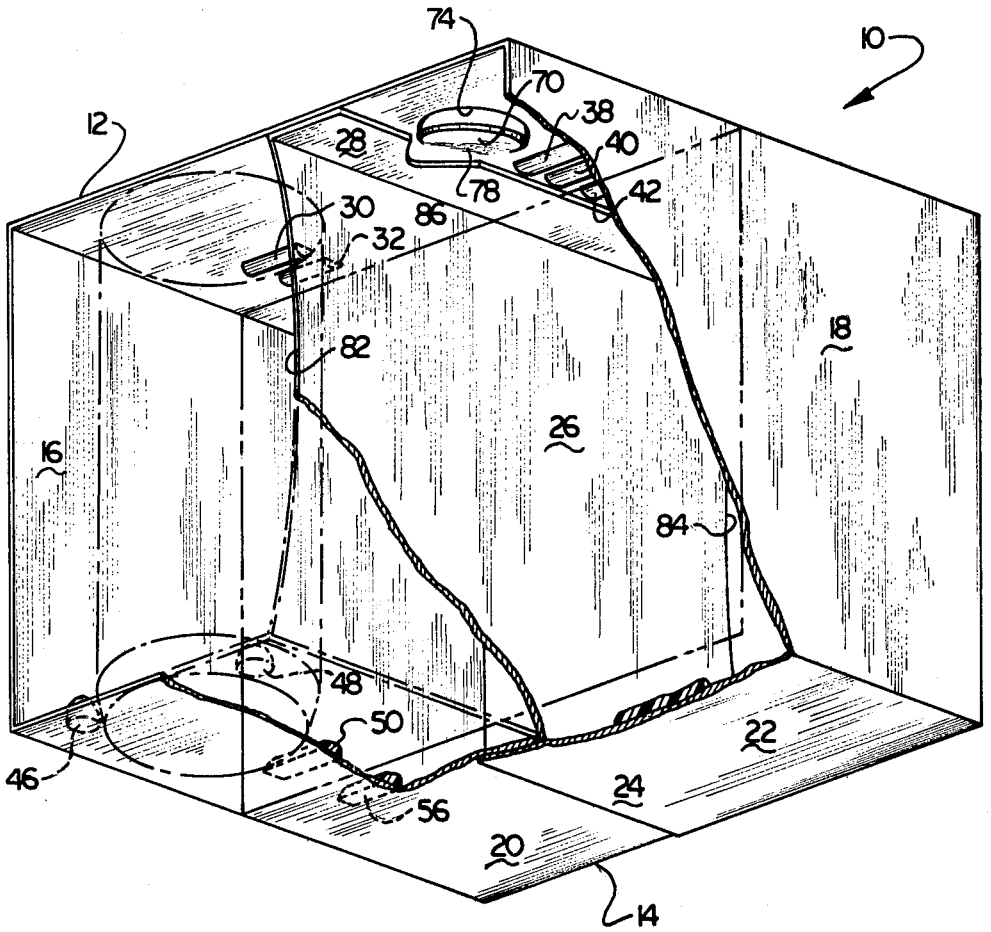
FIG. 2 is a fragmentary isometric view, from outside the bottom wall, of a carrier according to the present invention, with a phantom representation of a carried article.

Turning to the figures of drawing, wherein like structural elements are identified by like reference numerals, a preferred embodiment of a carrier blank 10' is shown in FIG. 1 from which an assembled carrier 10, shown in FIG. 2, may be constructed. For ease of description herein, the face of the blank, which comprises a continuous array of panels, shown in FIG. 1 will be referred to as the "obverse face" and the opposite face as the "reverse face".

The carrier illustrated in FIG. 2 is comprised of a top wall 12, a bottom wall 14 and two substantially identical side walls 16 and 18. (The terms top wall and bottom wall are used solely to aid description of walls 12 and 14 and do not indicate a particular orientation of the carrier.) Bottom wall 14 is comprised of two half walls 20 and 22 joined along a margin 24 of half wall 22 which partially overlaps half wall 20. A reinforcing panel 26 extends from inside bottom wall 14 to inside top wall 12 and has a tab 28 which is secured to and bears on the inside of top wall 12.

Carrier 10 includes a plurality of retaining or engaging elements which serve as latch or restraining means to secure articles placed in the carrier in proper position. Thus, in contrast to the prior art, the present invention provides flapless latch means. The embodiments shown in FIGS. 1 and 2 include retaining elements 30, 32, 34, 36, 38, 40, 42 and 44 disposed on the inside of top wall 12, retaining elements 46, 48, 50, 52, 54 and 56 disposed on the inside of half wall 20 and retaining elements 58, 60, 62, 64, 66 and 68 disposed on the inside of half wall 22, although some of these retaining elements are obscured from view in FIG. 2 by other carrier members.

A pair of tabs 70 and 72 are formed in top wall 12 by arcuate cut lines 74 and 76. Tabs 70 and 72 are hinged to top wall 12 by score lines 78 and 80, respectively, closing the figures formed by cut lines 74 and 76, respectively. In the assembled carrier 10, when the tabs 70 and 72 are folded into the carrier convenient finger grips to lift the carrier are provided.

Reinforcing panel 26 is formed with arcuately cut edges 82 and 84 as shown in FIG. 1. Tab 28 depending from the end of panel 26 is formed with a notch 86 aligned with tab 70 to permit tab 70 to hinge fully along score line 78 so that the tab 28 does not interfere with easy gripping of the carrier.

FIG. 1 shows the relationship of the walls and panel of blank 10′ from which carrier 10 may be formed. Margin 24 is an extension of half wall 22, which in turn is attached to side wall 18 along a lateral fold line 88. (For ease of description, lines parallel to fold line 88 will be referred to herein as "lateral", while all lines perpendicular thereto will be described as "transverse", regardless of actual orientation.) The border of side wall 18 opposed to fold line 88 adjoins top wall 12 along lateral fold line 90 and top wall 12 adjoins side wall 16 along another lateral fold line 92. Half wall 20 adjoins side wall 16 and panel 26 along lateral fold lines 94 and 96, respectively. Reinforcing panel 26 terminates in flap 28 along a lateral fold line 98.

As previously mentioned, tabs 70 and 72 may be formed in top wall 12 when the articles carried have hollow end portions abutting the top wall, providing convenient finger holes for lifting and transporting carrier 10. The tabs also add to the security with which the articles into which they project are held within the carrier. When tabs are used to provide a finger hole handle, it may be necessary to provide a notch 86 in tab 28 to permit the tab to be folded fully perpendicular to top wall 12.

In the preferred embodiment shown in FIGS. 1 and 2, the transverse edges of reinforcing panel 26 are arcuate having a medial narrowmost width. The arcuate edges aid visual display of the articles within the carrier without disturbing the structural and cushioning functions of the panel. It may also be desirable to shape the transverse edges of side panels 16 and 18 similarly arcuate to further display the articles. Alternatively, panel 26 may have straight or even protruding arcuate transverse edges within the spirit of the invention to add to the protection afforded the carried articles by the carrier. In the later case it may be desirable that the transverse edge of side panels 16 and 18 also protrude.

Assembly of the carrier 10 from the blank 10′ or from variations of the blank wihin the spirit of the invention is achieved very simply. The blank of FIG. 1, preferrably formed from a flexible, resilient material such as paperboard or plastic, is stamped, punched or die cut to the desired shape and all of the fold, score and cut lines are formed simultaneously. Preferably, all such lines may be cut, indented or embossed from a single side of the blank. Once the blank is cut, scored and embossed as desired, the retaining elements are applied to the blank. The obverse sides of tab 28 and margin 24 are then prepared for joining to other parts of the carrier, preferably by the application of an adhesive to them. The blank is then folded along fold lines 92–98 so that the obverse face of tab 28 is brought in contact with and joined to the central portion of the obverse face of top wall 12 thereby forming a first cell or sleeve. The blank is then folded along fold lines 88 and 90 so that margin 24 partially overlays half wall 20 and is then joined to it forming a second cell completing the sleeve of this embodiment of the invention. The assembled carrier may then be collapsed through the cooperation of the hinges formed by fold lines 88–98 for shipment to another location for insertion of the articles to be carried or may be used as assembled. In either event, the carrier is put into use by the insertion of the articles to be carried into the sleeves.

With the configuration of latching elements shown in FIG. 2, insertion of articles having cylindrical end and hollow end portions into an assembled carrier is particularly simple. An article is inserted at an angle so that one end portion engages the retaining elements as intended and then the other end portion is swung into the carrier and "popped" into place. Although the transverse dimension of the side walls of the carton is chosen to be substantially equal to the distance between the opposing end portions of the carried articles, the flexibility and resiliency of the carrier material permits sufficient temporary carrier distortion to allow insertion of an article at an angle and restoration of the original carrier shape after the both end portions of the article are seated. Removal of the objects may be accomplished in a reverse manner or by destruction of the carrier.

Retaining elements 30–68 function to latch the carried articles preventing inadvertent removal or loss of the articles from within the carrier. The configurations of the latch, i.e. the retaining elements, depend upon the shape of the opposing ends of the articles to be carried. To latch an end portion of an article that is cylindrical, it is preferred to use the configuration two of which are shown in FIG. 1 on half wall 20. This configuration consists of two generally hemispheric three-dimensional elements, e.g. 46 and 48, disposed near the outside edge of the wall and an elongate transverse element, e.g. 50, near the center of wall 20. The elements are arranged to engage or proximally surround the periphery of the cylindrical end portion, and as illustrated in FIG. 2 (with a drinking glass shown in phantom), thereby to prevent the end portion from moving significantly when the carrier is subjected to shock or other forces. A hollow, recessed or chimed end portion may be latched by the configuration of elements shown in FIG. 1 on top wall 12. That configuration consists of pairs of elongate transverse elements, e.g. 30 and 32, which are rather closely spaced near the transverse medial line of the top wall. The separation of elongate elements 30 and 32 is chosen so that they bound proximally the inside and outside of the edge of the chimed, recessed or hollow end portion of the article to be restrained. The restraining or latching function is accomplished by the combination of the retaining elements which may, but need not, simultaneously contact an article. It is sufficient that the elements inhibit movement of an end of an article beyond locations where there is little likelihood that the article will become separated from the carrier.

It is an important advantage of this invention that articles of almost any shape and having two opposed end portions may be carried. Carriers using flaps and the like to retain articles have generally been limited to carrying articles having substantially circular ends. But with the present invention, almost any shape end may be accommodated by configuring the retaining elements to bear on or proximally engage the periphery, or in the case of a chimed, hollow or recessed end portion on the rim, of each end portion. Such configurations may require different arrangements, shapes and fewer or greater numbers of retaining elements from those shown in the preferred embodiment depicted in FIGS. 1 and 2. For example, a square end portion might be restrained by four retaining elements or by two elongate elements in cooperation with a side wall and the reinforcing panel. In another example, the three element circular end portion restraint shown on half wall 20 might be replaced by two retaining elements, one or both of which might be elongate or curved, although the three element configuration is preferred to assure positive latching if only elongate and generally hemispheric elements are to be used. Along these lines, it should be appreciated that any configuration of retaining elements which bounds or proximally engages the periphery only (i.e. not disposed across an end surface) of the article to be restrained is deemed within the scope of the present invention. Accordingly, those skilled in the art may adapt the retaining elements to other configurations to suit particular applications of the present invention.

The retaining elements might be composed of a variety of materials, but I prefer that they consist of masses of a cured adhesive. The raw or uncured adhesive can be placed directly on the blank without the use of intermediate materials to form the retaining elements. Such elements may be formed into a variety of shapes to conform to a particular article end portion shape merely by controlling the motion of the adhesive-applying fixture. It is essential that the elements be cubic or three-dimensional, i.e. have volume, so that their masses positively resist substantial movement of the carried articles with respect to the carrier. In addition, it is desirable that the cured adhesive be resilient to cushion the articles from shocks to which the carrier may be subjected. I have found that cured foamed plastic adhesives are particularly suitable for forming the retaining elements providing the adhesive and cushioning properties desired.

Another preferred embodiment of the carrier according to the invention may be prepared by halving the blank of 10' of FIG. 1 along the indicated transverse centerline. The two two-article carriers formed by assembling two halved blanks are indicated by the dashed lines shown in FIG. 2 in the illustration of the embodiment previously described. An obvious addition of a pair of tabs is necessary in the halved configuration if two finger holes are desired in each carrier.

Figure 3:
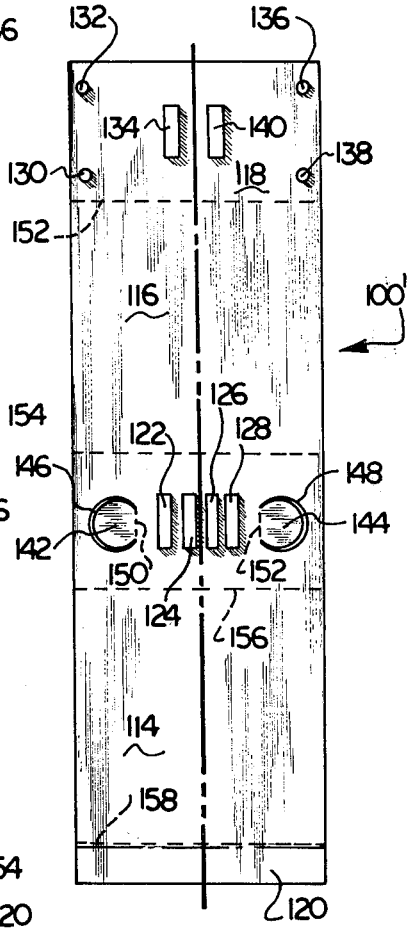
FIG. 3 is a plan view of an alternate embodiment of a blank from which a carrier of the present invention may be formed.
Figure 4:
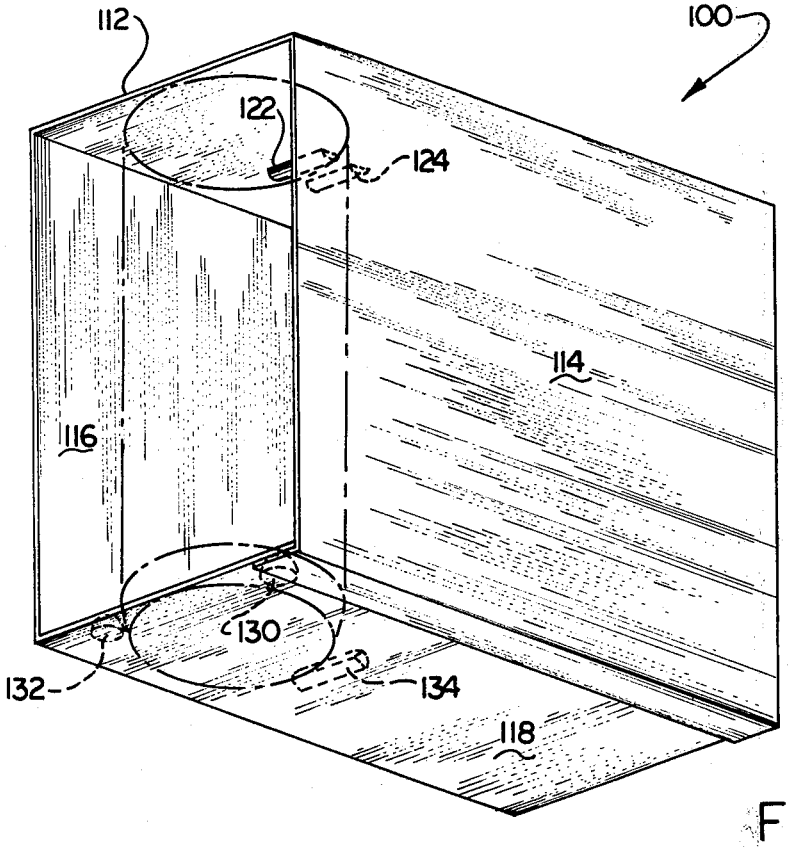
FIG. 4 is a fragmentary isometric view, from outside the bottom wall, of a carrier according to the present invention, with a phantom representation of a carried article.

In still another embodiment, a two-article carrier may be constructed by eliminating one of the cells from the carrier embodiment shown in FIG. 2. This embodiment may be assembled from a blank 100', the obverse side of which is shown in FIG. 3, to form a carrier 100 shown in FIG. 4. Blank 100' is entirely analogous to blank 10' of FIG. 1 without center panel 26 or half wall 20. Carrier 100 has a top wall 112, two side walls 114 and 116, a bottom wall 118 and a margin 120 for joining side 114 to bottom wall 118. Top wall 112 has retaining elements 122, 124, 126 and 128 and bottom wall 118 has retaining elements 130, 132, 134, 136, 138 and 140. As explained in connection with the preferred embodiment of carrier 10 illustrated in FIG. 2, the elements may have numerous configurations so long as they function together to latch within the carrier the end portions of the articles to be carried. Carrier 100 also has tabs 142 and 144 created by arcuate score lines 146 and 148 on top wall 112. Tabs 142 and 144 are hinged to top wall 112 along score lines 150 and 152, respectively, which close the figures produced by respective score lines. Bottom wall 118 and side wall 116 are joined along lateral fold line 152, side wall 116 and top wall 112 are joined along lateral fold line 154, top wall 112 and side wall 114 are joined along lateral fold line 156 and margin 120 joins side wall 114 along lateral fold line 158. Assembly of blank 100' to form carrier 100 is completely analogous to the assembly of blank 10 of FIG. 1 omitting the steps for panel 26 and flap 28. This embodiment of the invention lacks the stability and cushioning provided by panel 26 in the embodiment of FIG. 2, but is nonetheless useful where the nature of the articles eliminates the need for such functions.

Yet another embodiment of a carrier according to the invention may be created by halving blank 100' of FIG. 3 along the indicated transverse center line. Such a carrier would accommodate but one article and would have the appearance of one half the carrier depicted in FIG. 4.

The embodiments of the invention thus described are believed to provide a carrier for articles using the least amount of carrier material consistent with the stability and article cushioning required for particular articles. The top-to-bottom wall dimension of a carrier is substantially the distance between the ends of the carried articles. The side wall-to-side wall separation is substantially one or more times the breadth of the articles, depending on the number of articles to be carried. The flapless latching system of the invention thus permits the carrying of articles having two opposing end portions of nearly any shape without the use of additional carrier material to retain the articles within the carrier.

While the invention has now been described with reference to certain preferred embodiments, the skilled artisan will recognize that various substitutions, changes, modifications and omissions may be made without departing from the spirit thereof. Accordingly, it is intended that the scope of the invention be limited solely by the following claims.

I claim:

1. A carrier formed from a sheet material for receiving at least one article having two opposing end portions, said carrier comprising:

top and bottom walls;

a pair of side walls, each side wall being hingedly attached to each of said top and bottom walls to form a carrier sleeve; and at least two three-dimensional retaining elements extending from said top wall engageable with an end portion of an article inserted into said carrier, for blocking the article from slipping out of said carrier, wherein each of said retaining elements comprises a mass of a cured adhesive that has adhered itself to said top wall.

2. The carrier of claim 1 wherein said retaining elements are disposed on said walls for peripheral proximate engagement of an end portion of an inserted article.

3. The carrier of claim 1 for receiving an article having at least one chimed, recessed or hollow end portion, wherein at least one of said retaining elements is disposed for proximate engagement of an inserted article within its chimed, recessed or hollow end portion.

4. The carrier of claim 1 wherein said retaining elements further comprise cushioning means for cushioning end portions of inserted articles.

5. The carrier of claim 1 for at least one pair of articles further including a reinforcing panel disposed within said carrier, said panel being opposed to said side walls and hingedly connected to said top and bottom walls.

6. A blank formed from a sheet material for forming a carrier for receiving at least one article having two opposing end portions, said blank comprising a continuous array of panels joined by lateral fold lines including: a bottom wall, a first side wall, a top wall and a second side wall, and having extending from said top wall at least two three-dimensional retaining elements for blocking the end of an article inserted into said carrier from slipping out of said carrier, wherein each of said retaining elements comprises a mass of a cured adhesive that has adhered itself to said top wall.

7. A blank formed from a sheet material for forming a carrier for receiving at least one pair of articles each having two opposing end portions, said blank comprising a continuous array of panels joined by lateral fold lines including: a first bottom wall, a first side wall, a top wall, a second side wall, a second bottom wall and a reinforcing panel, and having extending from said top wall at least two three-dimensional retaining elements for blocking an end of each of a pair of articles inserted into said carrier from slipping out of said carrier wherein each of said retaining elements comprises a mass of a cured adhesive that adhered itself to said top wall.

* * * * *